US007364100B2

(12) United States Patent
Pallmann

(10) Patent No.: US 7,364,100 B2
(45) Date of Patent: Apr. 29, 2008

(54) APPARATUS FOR COMMINUTING MATERIAL WITH A SEPARATE AIR SUPPLY

(75) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 144 days.

(21) Appl. No.: 11/249,713

(22) Filed: Oct. 14, 2005

(65) Prior Publication Data

US 2006/0086856 A1 Apr. 27, 2006

(30) Foreign Application Priority Data

Oct. 14, 2004 (DE) ..... 10 2004 050 002

(51) Int. Cl.
*B02C 7/17* (2006.01)

(52) U.S. Cl. ..... 241/66; 241/261.2

(58) Field of Classification Search ..... 241/65, 241/66, 67, 261.2, 261.3
See application file for complete search history.

(56) References Cited

U.S. PATENT DOCUMENTS 2,211,518 A * 8/1940 Scherbaum ..... 241/66
3,055,598 A * 9/1962 Ginaven ..... 241/57
4,383,650 A 5/1983 Contal et al.

FOREIGN PATENT DOCUMENTS

DE 10 71 452 B 12/1959
EP 0 024 966 A1 3/1981

* cited by examiner

*Primary Examiner*—Mark Rosenbaum
(74) *Attorney, Agent, or Firm*—Muncy, Geissler, Olds & Lowe, PLLC

(57) ABSTRACT

An apparatus for comminuting material includes two disks arranged coaxially to one another inside a housing that encloses a comminuting room. At least part of the opposing surfaces of the disks are provided with interacting comminuting tools thus forming a comminuting zone, whereby at least one of the disks rotates around a mutual axis to generate a relative movement of the disks. At the same time, the material, which is a mixture of gaseous and solid materials is axially fed by one of the disks into the comminuting room and is radially conveyed to the comminuting zone. Thereby, cooling gas is additionally channeled into the comminuting room. The comminuting room is partitioned into one chamber through which the mixture of gaseous and solid materials flows, and at least one additional chamber dedicated to the cooling gas.

14 Claims, 5 Drawing Sheets

APPARATUS FOR COMMINUTING MATERIAL WITH A SEPARATE AIR SUPPLY

This nonprovisional application claims priority under 35 U.S.C. § 119(a) on German Patent Application No. DE 102004050002, which was filed in Germany on Oct. 14, 2004, and which is herein incorporated by reference.

BACKGROUND OF THE INVENTION

1. Field of the Invention

The present invention relates to an apparatus for comminuting material with a separate air supply.

2. Description of the Background Art

Devices of this class are characterized by an air-ventilated mode of operation. Air, together with a mixture of gaseous and solid materials, is thereby axially channeled into a comminuting room, and after radial rerouting is conveyed by centrifugal forces to an annular comminuting zone, where it is comminuted between the comminuting tools to a desired size. After exiting the comminuting zone, the suitably milled material gathers in a ring channel, which is located between the housing and the comminuting tools, where it is tangentially discharged by the air stream via the material discharge. Apart from the centrifugal forces, the driving force for the transport of the material through the comminuting apparatus is essentially the air flow, the sweeping force of which affects the material.

When the material is comminuted in the comminuting zone, a considerable part of the energy required for the comminuting is converted into heat. This is caused by friction and impact forces the material is subjected to during comminuting, which primarily affect the comminuting tools. The heating up of the material resulting therefrom carries the risk on the one hand, particularly with regard to heat-sensitive materials and/or fine and finest-milled materials, of the material to be irreversibly ruined, and on the other hand, of the comminuting device to suffer damage due to thermal stress.

Conventionally, the cooling of devices of this class is done via the air portion in the mixture of gaseous and solid materials that passes through the milling gap. A heat transfer from the comminuting tools to the air thereby takes place, whereby the desired cooling effect is achieved. Thus, devices of this class are characterized in that during the comminuting operation, the air flowing through the device has a transport function as well as a cooling function.

Furthermore, it is known to channel additional air into the comminuting room. The additional air volume is able to remove heat, thus increasing the cooling effect. Again, the heated air is discharged together with the suitably milled material.

The disadvantage of conventional comminuting devices is the dual function of the mixture of gaseous and solid materials, which on the one hand has the task of transporting the material, and on the other hand has the task of cooling. Under certain circumstances, for example, in the case of fine and finest milling, the air portion in the mixture must be increased beyond the volume needed for transport for reasons of cooling. As a consequence, large volumes must be filtered to separate the milled material from the mixture of gaseous and solid materials exiting the device. From a structural-technical point of view, this requires large filter surfaces and large conduit cross sections, which, apart from high investment and operation costs, also has the additional consequence of increased spatial requirements.

This disadvantage is also a characteristic of devices of this class, where additional cool air is channeled in because upstream to the comminuting zone, the additional cool air merges with the mixture of gaseous and solid materials.

Furthermore, only as an exception does the dual function of the mixture of gaseous and solid materials during the comminuting process lead to an optimal utilization of the comminuting device. In most cases, either the conveying potential of the air portion in the mixture of gaseous and solid materials is exhausted while there are still cooling reserves, or the cooling potential of the air portion is exhausted, although reserves in the conveying capacity would still be available. This leads to a diminished efficiency of conventional devices.

SUMMARY OF THE INVENTION

It is therefore an object of the present invention to improve comminuting devices of this class economically and functionally.

The invention recognizes the previously described correlations and based thereon, to provide a spatial separation of cooling and material transport utilizing a gas, primarily air.

The separation of the cooling gas stream from the mixture of gaseous and solid materials makes it possible to calculate the gas portion in the mixture of gaseous and solid materials solely in view of the desired conveying power. The result is a reduction of the gas volume in the mixture of gaseous and solid materials to a minimum. Because the cooling gas stream does not contain any solid materials, and only the volume-reduced mixture of gaseous and solid materials has to be run through filters, this measure has the advantage that smaller filter surfaces and conduit cross sections are sufficient to separate the milled material, resulting in lower investment as well as operational costs.

Simultaneously, the required amount of cool air can be channeled into the comminuting room, independently from the necessary conveying power and merely dependent on the prevailing temperature and the kind of material. This independent and thus varying control of the mixture of gaseous and solid materials and the cooled gas allows a maximal adaptation of the device of the present invention to outer parameters. This makes is possible to further minimize the operational costs and to achieve a more efficient operation.

An additional benefit of the separate conduit of the cooling gas is that the cool air stream is not hindered by the solid materials in the mixture of gaseous and solid materials. Thus, the present invention provides for an even and improved cooling effect on the comminuting tools.

According to a further embodiment of the present invention, a partitioning of the comminuting room by a wall arranged in a plane that is radial to the axis of rotation is provided. The beneficial feature is the forming of two ringwheel-shaped chambers that primarily extend in a direction that is parallel to their flow-through direction.

Beneficially, the wall is partially formed by the disk that is provided with comminuting tools, adjacent to which, in a radial direction, is a ring wheel. Thus, the device of the present invention is reduced to a minimum of components. Because the wheel is also a part of the chamber for the cooling gas stream, an optimal cooling effect can be achieved in this way.

Due to the staggered arrangement in a peripheral direction of the two outlets for the mixture of gaseous and solid materials and the cooling gas in an embodiment of the present invention, an equalization of the two parallel line systems is possible with the benefit of better utilization of the available space.

In a particularly preferred embodiment of the present invention, a stationary disk is formed by the front and rear walls of the housing. In this way, a compact construction of a device of the present invention is attained.

Beneficially, the stationary disk is formed by the intake side of the housing wall because this results in an extremely simple axial feeding of the material into the comminuting zone.

In a further embodiment of the invention, two rotating disk forming three separate chambers are provided. This allows an application of the invention in comminuting devices with differently rotating disks resulting in the desired effect that the comminuting tools are subjected to even attrition, and thus to even wear and tear.

In further development of such devices, the two outlets for the cooling gas can stream-upwardly and can be combined to eliminate the need for dual conduits.

To better utilize the cooling potential of the cooling gas, the cooling gas stream can be systematically channeled along the temperature-affected components by adding suitable fittings to the chamber. By arranging the fittings on a level with the comminuting tools, the cool air is channeled past the area with the highest heat development so that a maximum heat transfer takes place.

Further, the side of the disks facing the cool air chamber can be provided with ribs in order to enlarge the surface for the cooling gas, thus increasing the heat transfer.

By orienting the ribs radially, a flow-through of the chamber is achieved that results in a greater cooling effect. Additionally, with the disk rotating, the radially oriented ribs add a motion impulse to the cooling gas brushing by, thus further advancing the flow of cool air. The arrangement of the ribs in the area of the fittings thereby causes an interaction of these components and thus an improved cooling as well as conveying effect.

It is further preferred to arrange a temperature sensor in the comminuting room to emit, for example, an infrared beam, which, either continuously or at preset time intervals, registers the temperature in the comminuting zone. By evaluating the data, a temperature-depending control of the cooling gas stream is possible. In a further development of this idea, an automatic control, preferably by a microprocessor-powered control, is provided, which controls both the mixture of gaseous and solid materials and the volume of the cooling gas. In this way, an automated operation of the device of the present invention with continuous optimization is possible.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. For example, pin mills, refiners and the like are also within the scope of the invention.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
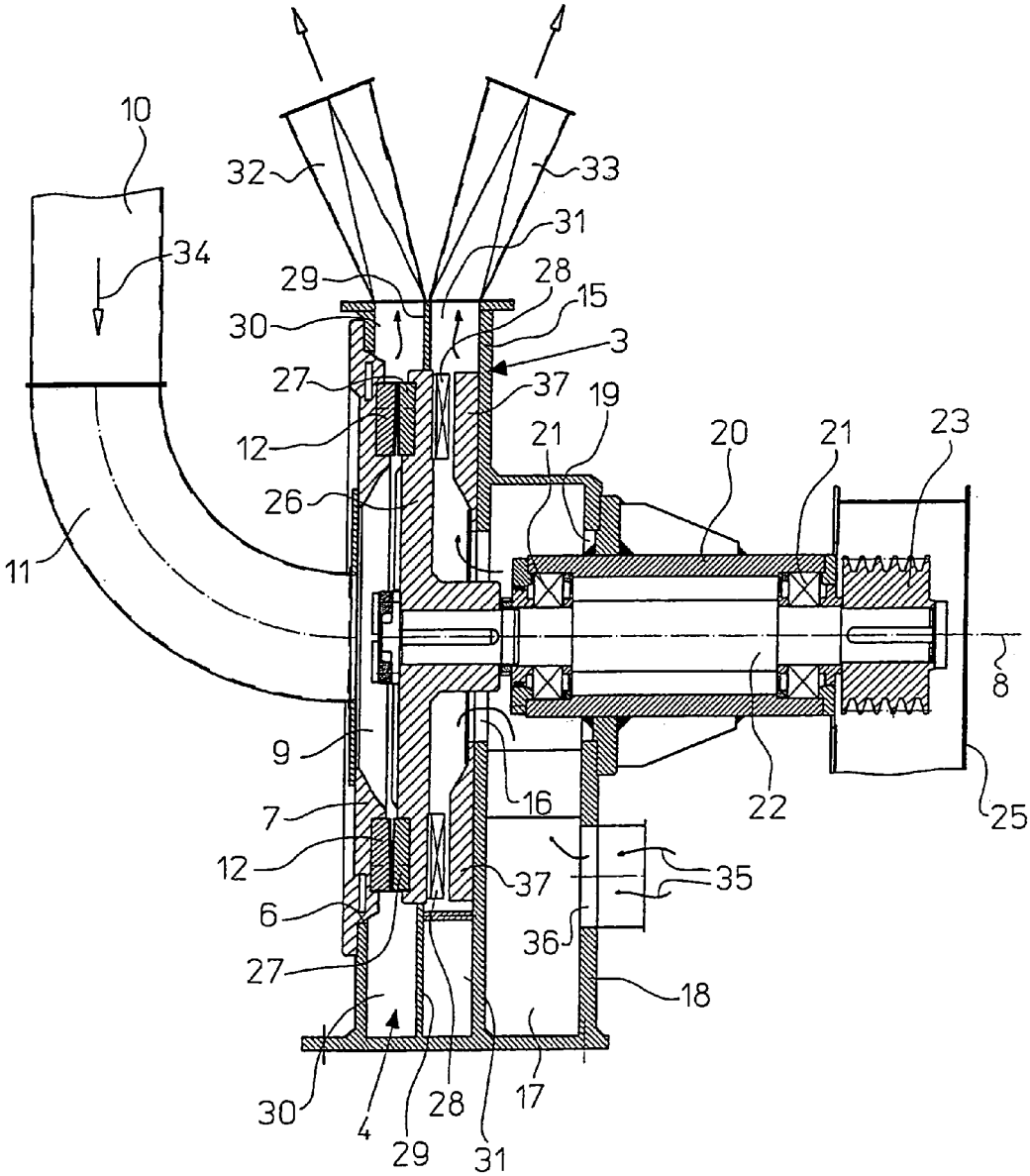
FIG. 1 is a longitudinal section of a device according to an embodiment of the present invention along the line I-I illustrated in FIG. 2.
Figure 2:
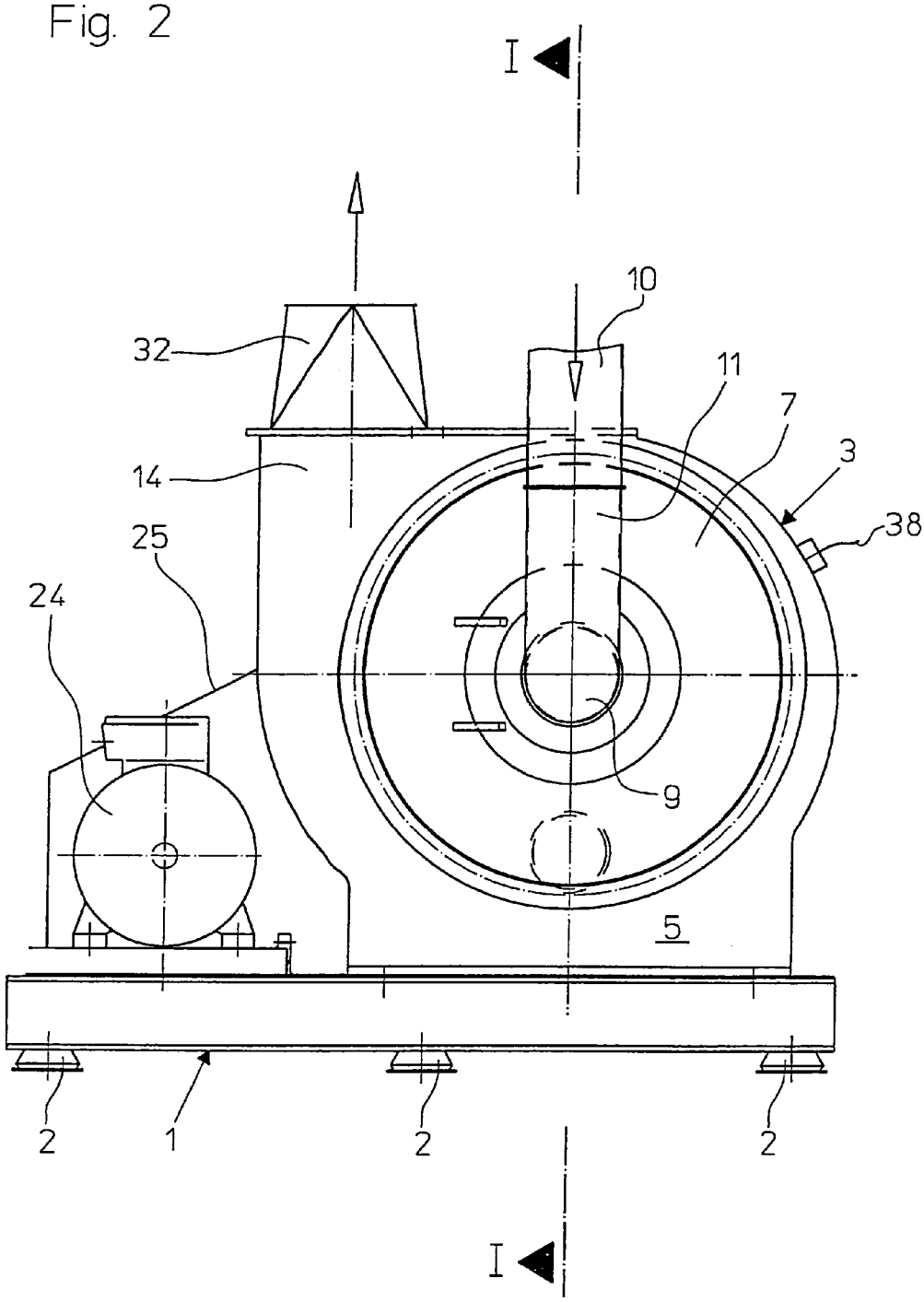
FIG. 2 is a front view of the device illustrated in FIG. 1.

FIGS. 1 and 2 show a first embodiment of the present invention, that is, a disc mill. To begin with, a machine substructure 1 is shown, which is illustrated in FIG. 2 only, the feet 2 of which rest on the ground floor. The upper part of the machine substructure 1 forms a platform, on which the comminuting apparatus of the present invention is mounted.

The comminuting apparatus includes a drum-shaped housing 3 that encircles a rotational axis 8 such that a comminuting room 4 is formed. On its front side 5, the housing 3 has a central circular opening 6, which can be closed and bolted shut with a housing door 7 that is pivotable around a vertical axis.

The housing door 7 also has a central circular feeder opening 9, to the outside of which a chute 10 is connected via a round arc 11. The inside of the housing door 7 expands conically starting from the rim of the feeder opening 9. The wider inner cross section of the feeder opening 9 resulting therefrom is surrounded by comminuting tools 12, which are arranged around the axis 8 in a circular shape, thus forming a milling ring. The comminuting tools are therefore fixedly mounted to the inside of the housing door 7, which in this way assumes the function of the first milling disk.

In the area of the rotational axis 8, a rear wall 15 also has a circular opening 16. Adjacent to the outside of the rear wall 15 is a box-shaped reinforcement 18, which encloses a cavity 17 that is parallel to the comminuting room 4. The box-shaped reinforcement 18 also has a circular opening 19 in the area of the axis of rotation 8. A further opening 36 is provided in the bottom area of the box-shaped reinforcement 18, through which the cavity 17 can be supplied with cool air 35. Coaxially to the axis of rotation 8, an arrangement of horizontal shaft bearings 20 is provided, which is fixedly connected to the box-shaped reinforcement 18 and extends into the opening 19.

In the arrangement of shaft bearings 20, a freely rotatable drive shaft 22 is mounted within the bearing group 21, the front end of which extends through the opening 16 in the rear wall 15 of the housing 3 into the comminuting room 4. Attached to its exterior end is a multiple-groove pulley 23, which is connected by straps to the drive motor 24, which is only illustrated in FIG. 2. The straps extend thereby inside a protective sheathing 25.

On the opposite end of the drive shaft 22 extending into the comminuting room 4, a circular hub plate 26 is mounted. Thus, the hub plate 26 is arranged plane-parallel and at a distance to the housing door 7. The hub plate 26 is also provided with comminuting tools 27 forming a milling ring, which are positioned opposite the comminuting tools 12 at a narrow axial distance, thus forming a milling gap, both interacting to comminute the material.

At the level of the comminuting tools 27, radially oriented ribs 28 are evenly distributed around the periphery of the side of the hub plate 26 that faces the rear wall 15. The ribs can be 5-25 mm high and can be spaced at mutual peripheral intervals of 20-100 mm. Due to their rigid attachment to the hub plate 26, the ribs 28 and the hub plate 26 together execute a rotational motion around the axis 8.

On the rear wall 15 of the housing 3, axially across from the ribs 28, air-conducting elements 37 are attached, which narrow the flow-through cross section in this area. In this way, cool air 35 is systematically directed to the components that show the highest heat development. Furthermore, the rotating ribs 28 interact with the air-conducting elements 37 such that the cool air stream also has a conveying effect.

Adjacent to the peripheral side of the hub plate 26, located in a radial plane, is a ring wheel 29. Across its outer periphery, the ring wheel 29 is rigidly connected to the housing 3, whereas its inner periphery forms a gliding connection to the hub plate 26. In this way, the ringwheel-shaped comminuting room 4 is separated into two chambers 30 and 31, which are also ringwheel-shaped. The partition wall formed by the hub plate 26 and the ring wheel 29 extends in a radial plane.

As can be particularly seen in FIG. 1, this partition also extends into the area of the material discharge 14, which is connected to a subsequent line system. A first line 32 is thereby connected to the chamber 30 to extract the milled material, and a second line 33 is connected to the chamber 31 to extract the cool air 35.

In addition, the comminuting device of the present invention is provided with a temperature sensor 38. The temperature sensor 38 is attached to the periphery of the housing 3 (FIG. 2), for example, and preferably includes an infrared sensor, which records the temperature in the comminuting zone, either continuously or at preset time intervals. The measured temperature can be directly displayed on a screen, or else can be transmitted to an automatic control.

During operation, the device of the present invention works as follows:

As indicated by the arrow 34, the material comprised of a mixture of gaseous and solid materials is fed axially into the comminuting room 4, via the chute 10 and the round arc 11, where it first encounters the top side of the hub plate 26. There it is rerouted into a radial direction and is drawn into the milling gap between the comminuting tools 12 and 27 by centrifugal forces. After exiting the milling gap, the milled material, together with the air portion of the mixture of gaseous and solid materials 34, passes on to the chamber 30 of the comminuting room 4, and is then conveyed via the first line 32 to a filter device (not shown), where a separation of the solid phase from the gaseous phase takes place. The mixture of gaseous and solid materials 34 is thereby characterized by its mixing ratio, whereby the gaseous portion is calculated such that it is able to transport the desired quantity of material to and through the device of the present invention. Although the gaseous portion of the mixture of gaseous and solid materials 34 has also a cooling effect in the comminuting zone, this does not have to be the deciding factor when determining the gaseous portion.

To cool down the comminuting zone, additional cool air, as indicated by arrows 35, is channeled into the comminuting device. The cool air 35 can be extracted from the ambient air, or can be derived from an air-conditioning system, and is channeled via the opening 36 into the cavity 17 of the box-shaped reinforcement 18. From there, the cool air 35 is channeled via the circular gap between the hub plate 26 and the opening 16 to the chamber 31 of the comminuting room 4. There, the cool air 35 is radially rerouted, and by utilizing the air-conducting elements 37, is directed to the ribs 28. When flowing through the ribs 28, a heat transfer from the ribs 28 to the cool air 35 occurs, resulting in a cooling effect at the same time. Subsequently, the cool air 35 exits the chamber 31 through the second line 33. Since the cool air 35 does not mix with the material, that is, with the milled material, there is no need for the cool air 35 to be run through filter devices to filter out solid materials.

During the comminuting process, the temperature in the comminuting zone is monitored with the temperature sensor 38. If a value is reached that may damage the material or the comminuting device, the volume of cool air 35 that is fed into the device is increased and/or the quantity of material that is fed into the device is reduced in order to attain the desired temperature in the comminuting zone. In this way, a device of the present invention can always be operated with an optimal mixing ratio of material to cool air at a predefined temperature. By using automatic controls, a fully automated operation can be realized.

Figure 3:
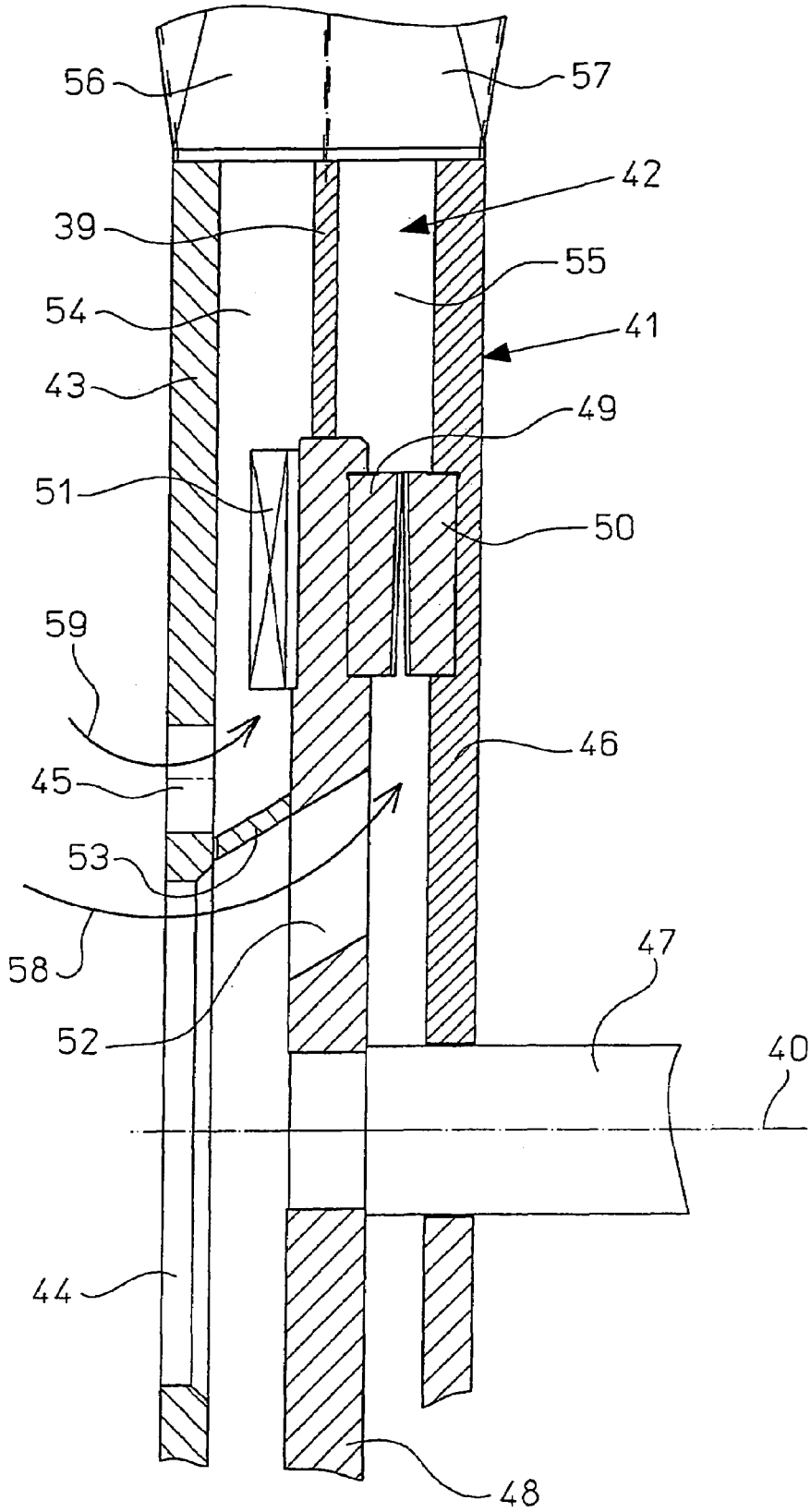
FIGS. 3 and 4 are additional partial cross sections according to further embodiments of the invention.

FIG. 3 illustrates a further embodiment of the present invention. The illustration is thereby limited to areas essential of the invention since the remaining structure is identical to the device described in FIGS. 1 and 2 so that the same applies. The layout corresponds with FIG. 1.

FIG. 3 also shows a drum-shaped housing 41 surrounding an axis of rotation 40, which encloses a comminuting room 42. The front side of the housing is formed by a pivotable housing door 43, which in the area of the axis 40 is provided with a concentric, circular feeder opening 44. Furthermore, additional openings 45 are provided in the housing door 43, which are arranged in a circle around the feeder opening 44.

In the area of the axis 40, the rear wall 46 of the housing 41 has a shaft exit for a drive shaft 47 (only partially illustrated), which extends into the comminuting room 42. At this end of the drive shaft 47, there is a milling disk 48 located in a radial plane.

In the outer peripheral area of the side of the milling disk 48 that faces the rear wall 46, a milling ring 49 is attached. Opposite thereto, at an axial distance, thus forming a milling gap, an additional milling ring 50 is located, which is fixedly connected to the rear wall 46 of the housing 41. In this embodiment, the rear wall 46 functions like a stationary milling disk.

On the side of the milling disk 48 that faces the housing door 43, radially oriented ribs 51 are positioned at a level with the milling ring 49, which are even distributed around the periphery of the milling disk 48 and rigidly attached thereto.

In the area between the drive shaft 47 and the milling ring 49, the milling disk 48 has openings 52, which connect the front side of the milling disk 48 to its rear side. Furthermore, an annular guiding plate 53 can be seen on the front side of the milling disk 48, which is fixedly attached to the milling disk 48 and glidingly connected to the feeder opening 44 in the housing door 43.

The comminuting room 42 of the present invention is divided into a chamber 54 and a chamber 55. Once again, the milling disk 48 and the ring plate 39 that connects to the milling disk 48 in a radial direction, serve as a partition wall. On its outer periphery, the ring wheel 39 is connected to the housing 41, and with its inner periphery, slidingly connects to the milling disk 48. The chamber-like partitioning of the comminuting device continues into the material discharge, where a first line 56 connects to the chamber 54 and a second line 57 to the chamber 55.

During operation, a mixture of gaseous and solid materials 58 is fed through the feeder opening 44 along the guiding plate 53 and through the openings 52 into the chamber 55, where is passes through the milling gap due to centrifugal forces while being milled. The sufficiently milled material, together with the air, is channeled to line 57, which leads to a filter device (not shown) for filtering out the solid particles.

Through the openings 45 in the housing door 43, the cool air 59 is channeled to the chamber 54, where it brushes radially along the ribs 51, whereby once again a cooling down of the comminuting zone takes place. The cool air 59 is discharged from the comminuting device via the line 56 and can be released directly into the ambient air without prior filtering, for example.

Figure 4:
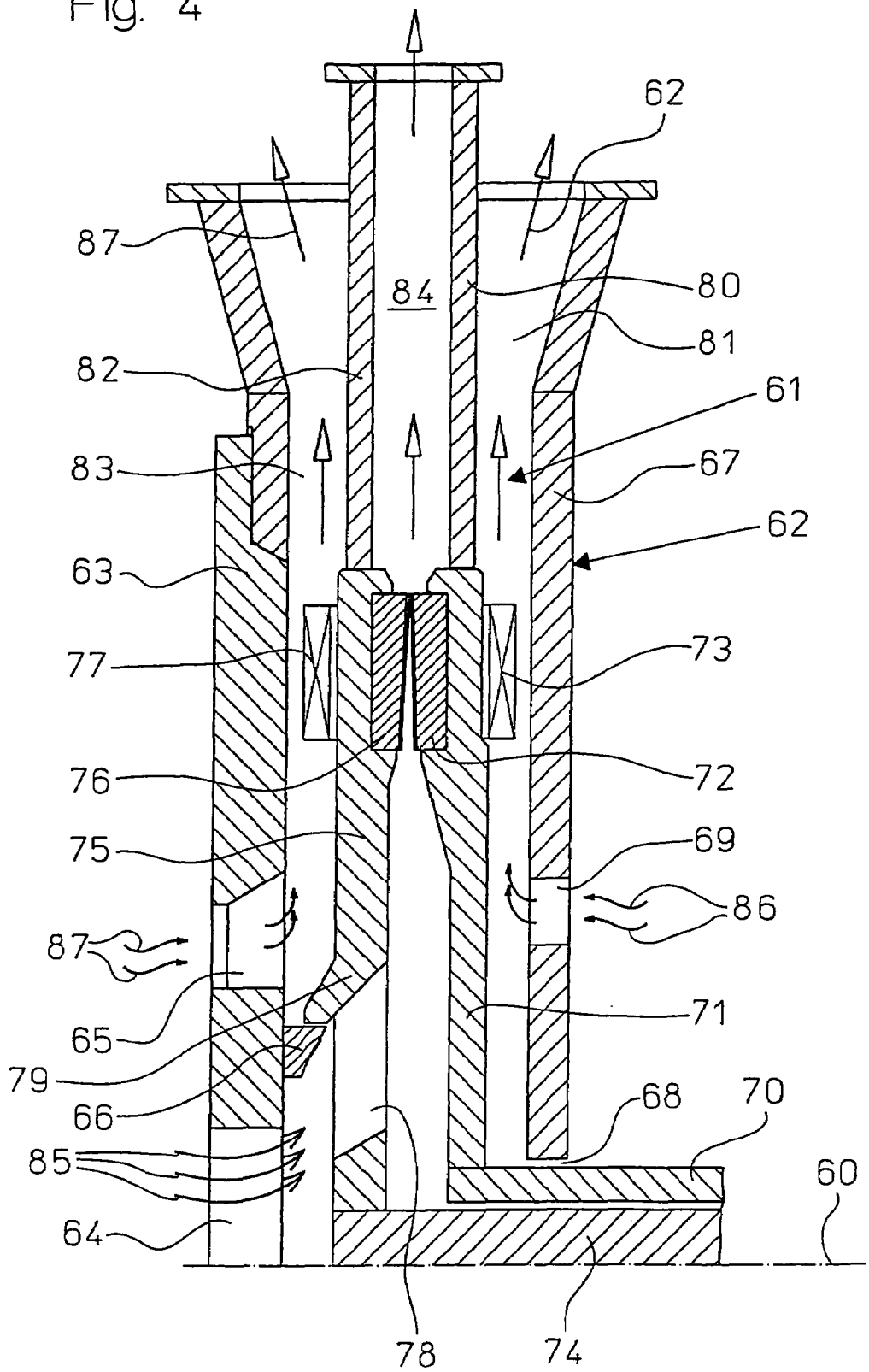

FIG. 4 illustrates an embodiment of the idea of this invention with a disc mill having two counter-rotating milling disks, whereby once again only the parts that are essential to the invention are shown. The remaining components that are not illustrated are almost identical to the device illustrated in FIGS. 1 and 2 so that reference is made to that part of the description.

The device illustrated in FIG. 4 has a drum-shaped housing 62 that surrounds an axis of rotation 60 and encloses a comminuting room 61. The front side of the housing 62 is formed by a pivotable housing door 63 that allows access to the housing interior.

In the area of the rotational axis 60, the housing door 63 has a central opening 64, through which material is fed into the device. The opening 64 is surrounded by additional openings 65, which are positioned on a circular periphery. The inside of the housing 63 has a circular connecting piece 66 that is concentric towards the axis of rotation 60.

In the area of the axis of rotation 60, the rear side 67 of the housing 62 has an opening 68 for receiving the drive shafts for the milling apparatus. Grouped in a circle around the opening 68 are yet again additional openings 69.

Extending in the area of the axis of rotation 60 is a first drive shaft 70 designed as a hollow shaft, the end of which extends into the comminuting room 61. The first drive shaft 70 is mounted, freely rotatable, inside a horizontal bearing arrangement. The horizontal bearing arrangement is not illustrated in FIG. 4 but is essentially identical to the one described in FIG. 1.

The end of the first drive shaft 70 supports a first milling disk 71, which is oriented in a radial plane to the axis of rotation 60. The milling disk 71 is thereby positioned at an axial distance to the rear wall 67 as well as to the housing door 63. On the side facing the housing door 63, the outer peripheral area of the first milling disk 71 is provided with a first milling ring 72. On the opposite side of the milling disk 71, in the outer circumferential area, first radial ribs 73 are evenly distributed around the periphery.

Inside the first drive shaft 70, a second, freely rotatable drive shaft 74 is arranged, the end of which extends beyond the end of the first drive shaft 70 into the comminuting room 61. This end supports a plane-parallel second milling disk 75, the outer peripheral area of which is provided with a second milling ring 76. The second milling ring 76 is thereby located axially opposite the first milling ring 72, thus forming a radial milling gap. On the opposite side of the second milling disk 75, second radial ribs 77 are evenly distributed around the periphery.

In addition, there is a plurality of openings 78 in the area between the second milling ring 76 and the drive shaft 74, which allow the passing-through of material from the front side to the rear side of the second milling disk 75. In the area of the openings 78, the second milling disk has an annular shoulder 79, which forms a sliding connection to the circular connecting piece 66.

On its peripheral side, the first milling disk 71 is surrounded by a first ring wheel 80, which is arranged in a radial plane. With its outer periphery, the ring wheel 80 is fixedly connected to the housing 62, whereas the inner periphery is glidingly connected to the first milling disk 71. In this way, a first disk-shaped chamber 81 is formed in the comminuting room 61.

On its peripheral side, the second milling disk 75 is surrounded by a second plane-parallel ring wheel 82, which with its outer periphery is also fixedly connected to the housing 62, whereas with its inner periphery, it is glidingly connected to the second milling disk 75. In this way, a second chamber 83 and a third chamber 84 are formed in the comminuting room 62. Upstream, the first chamber 81 and the second chamber 83 are merged in a common line, which is not illustrated in FIG. 4.

During operation, the device illustrated in FIG. 4 works as follows:

With the milling disks 71 and 75 counter-rotating, or rotating unidirectional with rotational speed difference, the material as indicated by arrows 85 is axially channeled through the openings 64 and 78 to the area between the millings disks 71 and 75. After encountering the milling disk 71, the mixture of gaseous and solid materials is radially rerouted and is drawn by centrifugal forces into the milling gap formed by the two milling disks 72 and 76. After comminuting, the sufficiently milled material is channeled into the annular chamber 84, where it gathers to be tangentially conveyed by the air stream via the material discharge to a filter device (not illustrated).

In order to prevent an overheating of the comminuting tools and the material, a first cool air stream indicated by the arrows 86 is channeled through the openings 69 in the rear side 67 of the housing 62 into the first chamber 81. In this way, a flow is generated in the first chamber 81 along the first milling disk 71, and particularly along the first radial ribs 73. Thereby, a heat transfer and thus a cooling of the comminuting tools takes place before the cool air 86 is tangentially discharged from the housing 62.

Likewise, a second cool air stream indicated by the arrows 87 is channeled from the front of the device through the openings 65 in the housing door 63 into the second chamber 83. The air flow thereby generated along the second milling disk 75, and particularly the second cooling ribs 77, allows a heat transfer and thus a cooling of the comminuting tools. The cool air stream 87 is also tangentially discharged from the housing 62.

The air 86 and 87 used for cooling can be directly taken from the ambient air, or else can be obtained via lines (not shown) from an air-conditioning system.

The best-possible symmetrical feeding of the device of the present invention with material and cool air allows a uniform temperature distribution in the comminuting zone and thus the best-possible utilization of the comminuting potential of a device of the present invention.

Figure 5:
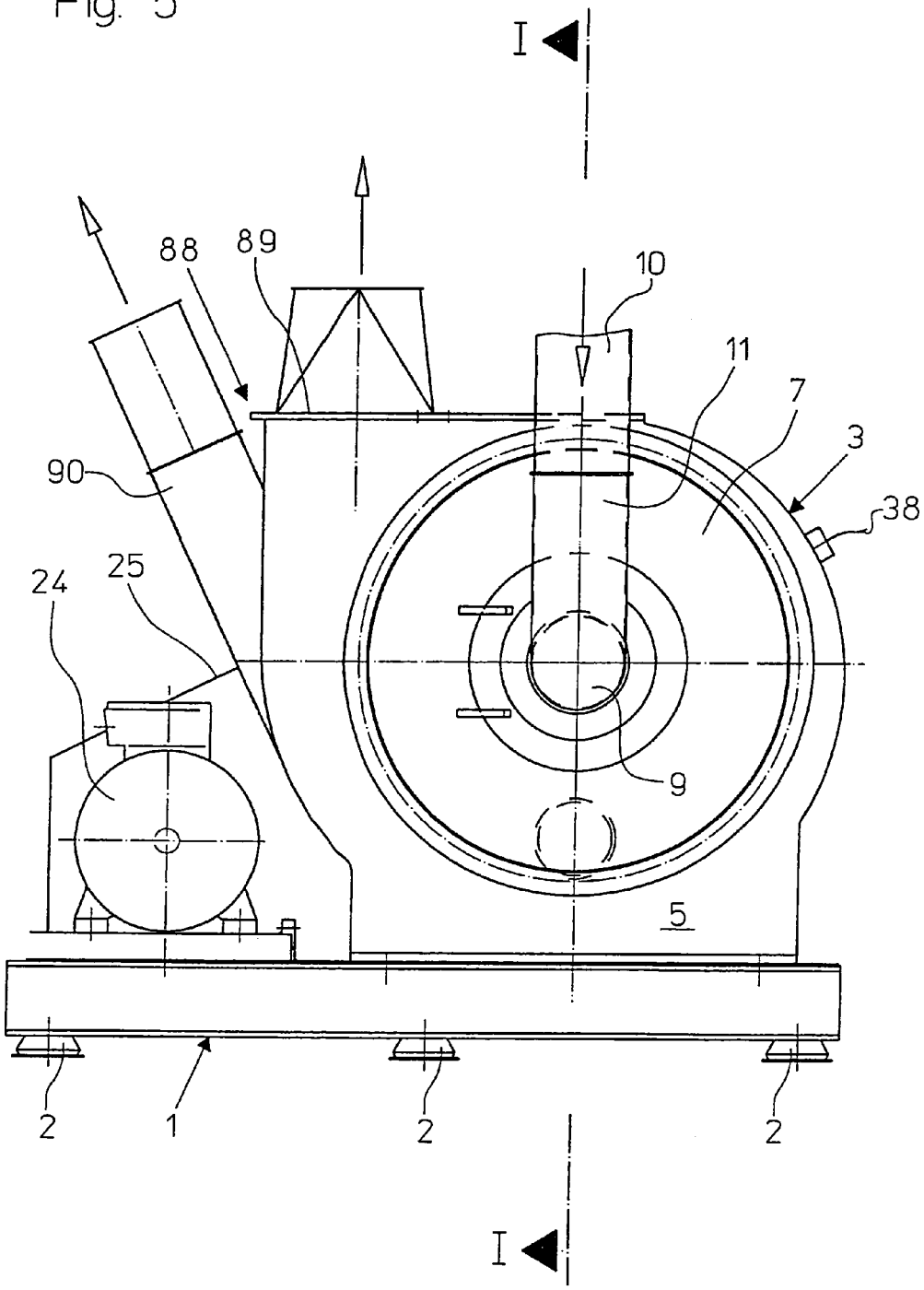
FIG. 5 is a front view of an additional embodiment of the invention.

FIG. 5 shows a device of the present invention, which is almost identical to the one illustrated in FIG. 1 so that by using identical reference numerals, reference is made to the corresponding part of the description of FIG. 1. The only difference is in the construction of the material discharge.

FIG. 5 illustrates a material discharge 88 that is split in two, comprised of a first discharge piece 89, which leads vertically upwards, and a second discharge piece 90, which terminates at an offset in a peripheral direction from the housing 3. In the chamber 30 illustrated in FIG. 1, the first discharge piece 89 is designated for the milled material, whereas the second discharge piece 90 is designated for the discharge of the cool air 35 from the chamber 31. The offset arrangement of the two discharge pieces 89 and 90 allows a better utilization of the available space with better accessibility.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for comminuting material comprising:

a housing for enclosing a comminuting room;

a first disk; and a second disk being arranged coaxially to the first disk inside the housing, at least a portion of opposing surfaces of the disks being provided with interacting comminuting tools thereby forming a comminuting zone, wherein at least one of the disks rotates around a mutual axis to generate a relative movement of the disks, and wherein the material, which is a mixture of gaseous and solid materials, is axially fed by one of the disks to the comminuting room and radially conveyed to the comminuting zone, wherein cooling gas is channeled into the comminuting room, wherein at least one wall is arranged in a plane that is radial to the mutual axis for partitioning the comminuting room into a first chamber through which the mixture of gaseous and solid materials flows and at least one additional chamber that is solely dedicated to the flow of cooling gas, and wherein the at least one wall is formed by the first disk or the second disk and a ring wheel that is radially adjacent thereto.

2. The apparatus according to claim 1, wherein a discharge for the mixture of gaseous and solid materials from the first chamber is arranged at an offset in a peripheral direction to a discharge for the cooling gas from the at least one additional chamber.

3. The apparatus according to claim 1, wherein either the first disk or the second disk is stationary and is formed by a front wall or a rear wall of the housing.

4. The apparatus according to claim 3, wherein a first stationary disk is formed by an intake side of the housing wall.

5. The apparatus according to claim 1, wherein at least one of the first disk or the second disk is provided with ribs on a side that faces the at least one additional chamber that is designated for the cooling gas.

6. The apparatus according to claim 5, wherein the ribs are oriented in a radial direction to the axis.

7. The apparatus according to claim 5, wherein the ribs are arranged in an area of the fittings.

8. The apparatus according to claim 1, wherein a temperature sensor is arranged in the comminuting room, with which the temperature in the comminuting zone can be registered.

9. The apparatus according to claim 1, further comprising automatic controls for controlling a volume of the mixture of gaseous and solid materials in relation to the comminuting output, and the volume of the cooling gas in relation to a temperature in the comminuting zone.

10. An apparatus for comminuting material comprising:

a housing for enclosing a comminuting room;

a first disk; and a second disk being arranged coaxially to the first disk inside the housing, at least a portion of opposing surfaces of the disks being provided with interacting comminuting tools thereby forming a comminuting zone, wherein at least one of the disks rotates around a mutual axis to generate a relative movement of the disks, and wherein the material, which is a mixture of gaseous and solid materials, is axially fed by one of the disks to the comminuting room and radially conveyed to the comminuting zone, wherein cooling gas is channeled into the comminuting room, wherein the comminuting room is partitioned into a first chamber through which the mixture of gaseous and solid materials flows and at least one additional chamber that is solely dedicated to the flow of cooling gas, and wherein the first disk and the second disk are rotatable and are respectively surrounded by a coaxial ring wheel so that between the first and second disks the first chamber for the mixture of gaseous and solid materials is formed, wherein, between a rear wall of the housing and the first disk, a second chamber for the cooling gas is formed, and wherein, between a front wall of the housing and the second disk, a third chamber for the cooling gas is formed.

11. The apparatus according to claim 10, wherein outlets for the second and third chamber are merged.

12. The apparatus according to claim 10, wherein fittings for the cooling gas are provided in at least one of the second chamber and the third chamber the chamber to guide the cool air stream along the disk.

13. The apparatus according to claim 12, wherein a radial distance of the fittings to the axis corresponds with a radial distance of the comminuting tools to the axis.

14. An apparatus for comminuting material, the apparatus comprising:

a housing for forming a comminuting zone therein;

at least one rotatable disk having at least one comminuting tool for comminuting material comprised of gaseous and solid materials, the rotatable disk rotating about an axis within the housing;

a material inlet formed in the housing, the material passing through the material inlet and towards the at least one comminuting tool;

an air inlet opening formed in the housing, cooling gas passing through the air inlet opening and into the housing for facilitating cooling of the at least one comminuting tool; and a ring wheel, the ring wheel being formed such that, in conjunction with the at least one rotatable disk, the material and the cooling gas is separately channeled in a comminuting chamber and a cooling chamber, respectively.

* * * * *